US005108357A

United States Patent [19]

Granger

[11] Patent Number: 5,108,357

[45] Date of Patent: Apr. 28, 1992

[54] DEVICE FOR DISPENSING FOLDED CUT WIPING MATERIAL

[76] Inventor: Maurice Granger, 17 rue Marcel Pagnol, 42270 Saint-Priest-en-Jarez, France

[21] Appl. No.: 523,779

[22] Filed: May 15, 1990

[30] Foreign Application Priority Data

May 16, 1989 [FR] France ..... 89 06823

[51] Int. Cl.[5] ..... A47K 10/36; B65H 45/20; B65H 45/22; B26D 1/56

[52] U.S. Cl. ..... 493/357; 83/334; 83/343; 83/348

[58] Field of Search ..... 493/356, 357, 439, 448; 83/334, 343, 344, 345, 348, 355, 660

[56] References Cited

U.S. PATENT DOCUMENTS

| | | | |
|---|---|---|---|
| 2,560,061 | 7/1951 | Agamaite | 83/322 |
| 3,038,718 | 6/1962 | Balsam | 493/448 |
| 4,206,858 | 6/1980 | DeLuca et al. | 225/96 |
| 4,621,755 | 11/1986 | Granger | 225/96 |

FOREIGN PATENT DOCUMENTS

| | | | |
|---|---|---|---|
| 1071156 | 2/1980 | Canada | 219/16 |
| 1128477 | 7/1982 | Canada | 219/29 |
| 1149342 | 7/1983 | Canada | 219/21 |

*Primary Examiner*—William E. Terrell
*Attorney, Agent, or Firm*—Eric P. Schellin

[57] ABSTRACT

A folded corrugated discrete web material dispensing device. The device having corrugation and cutting oppositely rotating cog wheels. The cog wheels are connected to a spring to store kinetic energy when the device is operated to continue the rotation of the cog wheel even after manually pulling is ceased.

6 Claims, 2 Drawing Sheets

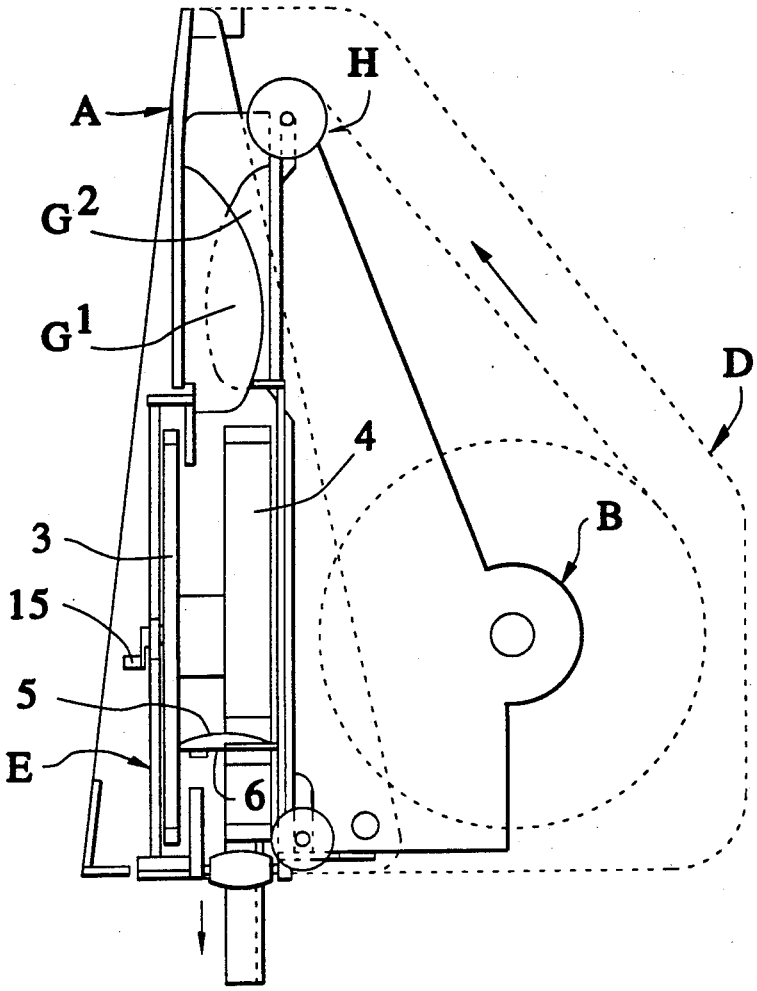
FIG. 1
FIG. 5
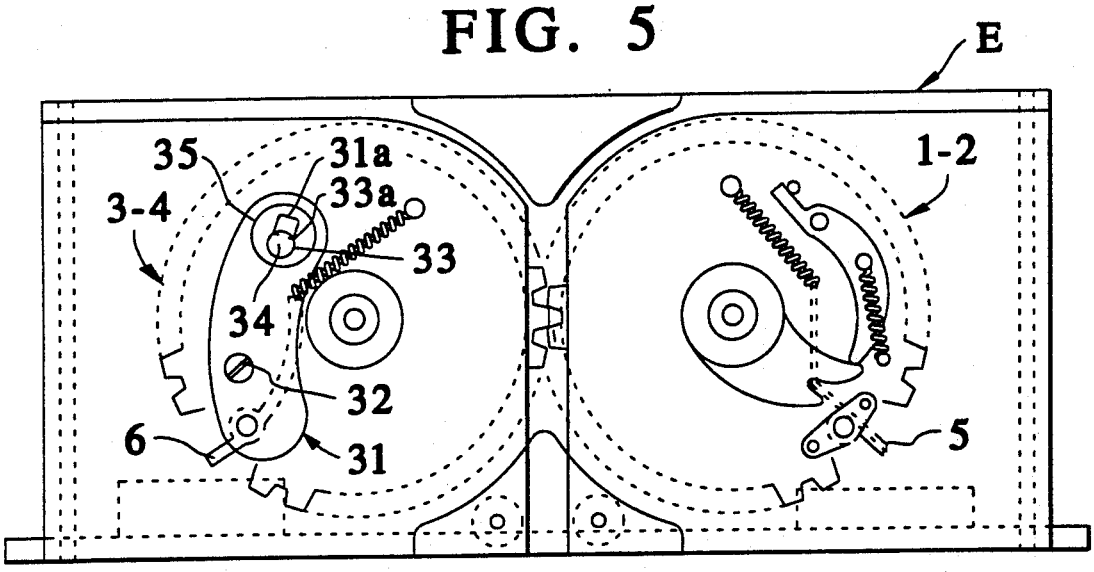

DEVICE FOR DISPENSING FOLDED CUT WIPING MATERIAL

CROSS-REFERENCES TO RELATED APPLICATIONS

The present invention is an improvement of the invention disclosed in copending application Ser. No. 07/224,408, filed: Jul. 26, 1988, now U.S. Pat. No. 5,013,291 and the division thereof, Ser. No. 07/641,723, filed: Jan. 15, 1991 and Ser. No. 07/487,198, filed Mar. 1, 1990. The subject matter of said U.S. patent applications are incorporated in their entireties by reference.

BACKGROUND OF THE INVENTION

There is considerable art relative to the art of dispensing web material such as paper towels from a roll of paper. Ideally such devices not only dispense the paper towel when a roll containing the paper towel is pulled but also cut the paper towel to provide discrete portions.

As paper towels have become thinner it has been found advantageous to increase the feel of bulkiness of such materials by folding longitudinally the paper towel. Also the folds which give a pleated effect provide greater strength to the towel to thereby resist breaking or tearing when the paper towel is pulled.

Therefore the object of the invention relates to the technical sector of devices to dispense wiping materials which may be fabricated of paper, cotton, wool, nonwoven and other types.

According to the basic patent application FR 89.03416 and the aforementioned copending U.S. patent and patent applications, the cutting device consists of two interacting metal blades with an elastical mount between two pairs of edge facing toothed drive wheels. The to-be-dispensed web wiping material is dispensed between the edges of wheels of one set as said wheels are rotated while the other set meshes to provide synchronized movement. As said wheels are rotated the blades are arcuately moved and gradually superimposed. The blades are in contact and pressure when in a position substantially parallel to the rotation shafts of the pairs of toothed wheels throughout the cut by shearing the previously folded strip of web-material payed between the said pairs of toothed wheels. The wheels are driven by manual pulling on the strip of web material projecting below from the unit.

Unfortunately with such a device, some premature tearing occurs and/or jamming of the cutting blades if the web material is tugged too gently. To overcome the jam it is frequently necessary to pull very forcefully thereby increasing the likelihood of a tear.

At the end of the pulling step, the pairs of toothed wheels return to their idle position after the cutting step. However, if the web material has been torn, the end of this web material be in the device and not readily accessible for the next pulling step.

SUMMARY OF THE INVENTION

In order to overcome these disadvantages, a pusher means is disclosed which operates when the two mentioned cutting blades come into contact. The pusher means is detailed to release energy which is retained when the pairs of toothed wheels rotate. This energy is imparted to of the set of pairs of wheels for further rotation;

According to a feature, the pusher consists of a two piece L-shaped lever operated upon by a cam keyed for rotation on one of the axle shafts of one of the pairs of toothed wheels. The cam is configured in order to firstly stress a spring connecting it to a fixed point on the surface of the oppositely disposed pair of toothed wheels. Thereby the spring is stressed as the cam is moved from an at rest position to a stressed position when the driven toothed wheels are rotated to bring into contact the cutting blades. Then the further rotation of the cam as the wheels rotate suddenly releases the lever while actuating the pair of toothed wheels opposite disposed to the wheels upon which the cam is journalled thereby imparting thereto rotational energy.

The rotational impetus is provided by the pusher rod which is connected to a spring central of the rod which has a hinged L-shaped configuration and a fixed point between the pairs of toothed wheels. The end of the pusher rod thereto meaningful against a suitably located projection on the drive wheel opposite to the one carrying the cam.

Furthermore, the device of the present invention is provided with means to vary to gap between the pairs of toothed wheels. This is accomplished by varying the position of one of the cutting blades by an adjustable means on one of the pairs of toothed wheels.

The latter may be accomplished by a blade holder which is hingedly mounted to one of the pair of toothed wheels. The said blade holder having an opening in which an eccentric can be turned with its axis on the said pair of wheels and thereby actuating the blade holder.

BRIEF DESCRIPTION OF THE DRAWINGS

FIG. 1 is a schematic view illustrating a unit according to the basic precepts for dispensing web wiping materials.

FIG. 5 is a front view of the interchangeable cassette fitted with the position adjusting means of one of the cutting blades.

DETAILED DESCRIPTION OF THE INVENTION

Figure 2:
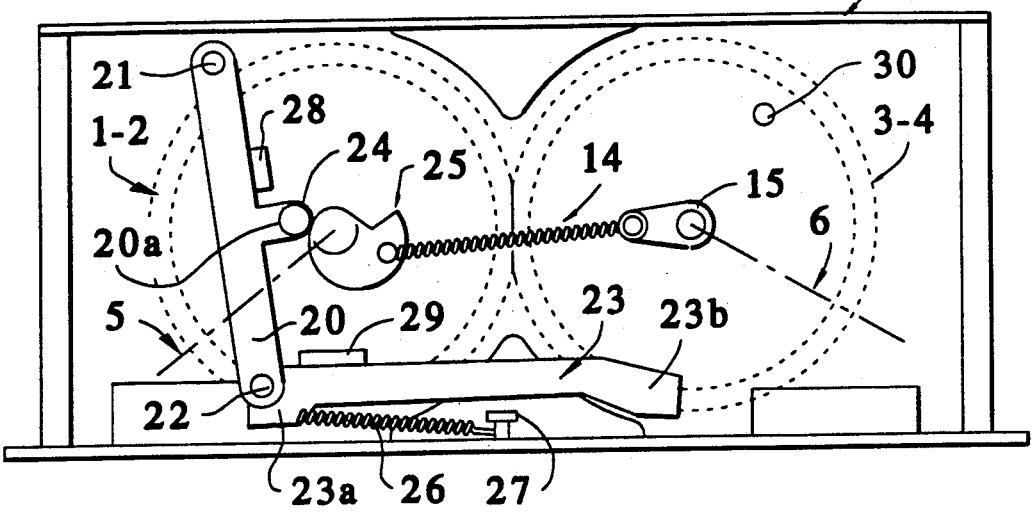
FIGS. 2, 3 and 4 are rear views of the interchangeable cassette fitted with the pusher means according to the invention.

Referring to FIG. 1, the main operating components of the device can be seen and as further illustrated and detailed in said copending patent and applications.

The device consists of a support base A which can be attached to any surface, a web material reel holder (B), an enclosure (D) therefore and a removable cassette (E). The latter is detailed to provide the mechanism necessary to propel and cut strips which have been previously folded longitudinally in accordion fashion or longitudinal corrugations. This has been accomplished by a series of interleaved spaced projections (G1–G2) defining a path between which the web material passes. One set of the projections is perpendicularly affixed to the support base (A) and the other set is perpendicularly affixed to the reel holder (B). The latter also supports a roller shaping means (H) over which the web material is payed from the reel and between the said projections to accomplish the corrugations. The cassette has means for sliding into the bottom opening of a housing defined by the base (A) and the enclosure (D) and is retained therein by suitable means not shown.

Between the front and rear faces of the cassette, there are two rotating pairs of cog-like wheels. The first pair consists of wheels 1 and 2 and the second pair consists of wheels 3 and 4. The wheels identified by reference numerals 1 and 3 are detailed to drivingly intermesh and engage. The wheels identified by reference numerals 2 and 4 have teeth that likewise intermesh but do not engage. The latter wheels have considerable greater width than the former and are detailed to permit the previously corrugatedly formed web material to pass between the cogs of wheels 2 and 4 as they rotate in opposite rotation to thereby impart to provide transverse corrugations to the web material.

The diameter therefore of the wheels 2 and 4, as they are in the nature of guide wheels are somewhat less than the diameter of wheels 1 and 3 which are in the nature of driving wheels. The latter are prone to backlash while the former are not, permitting the corrugated strip to pass therebetween without jamming.

The outside of cog wheels 2 and 4 have rounded edges thereby facilitating the insertion of the strip when loading the unit, whereas the inside of the teeth of the cog wheels 2 and 4 have a rough surface, particularly either side of the notches thereof to clear the cutting device in order to drive the separated strip after the cut without slipping.

Figure 3:
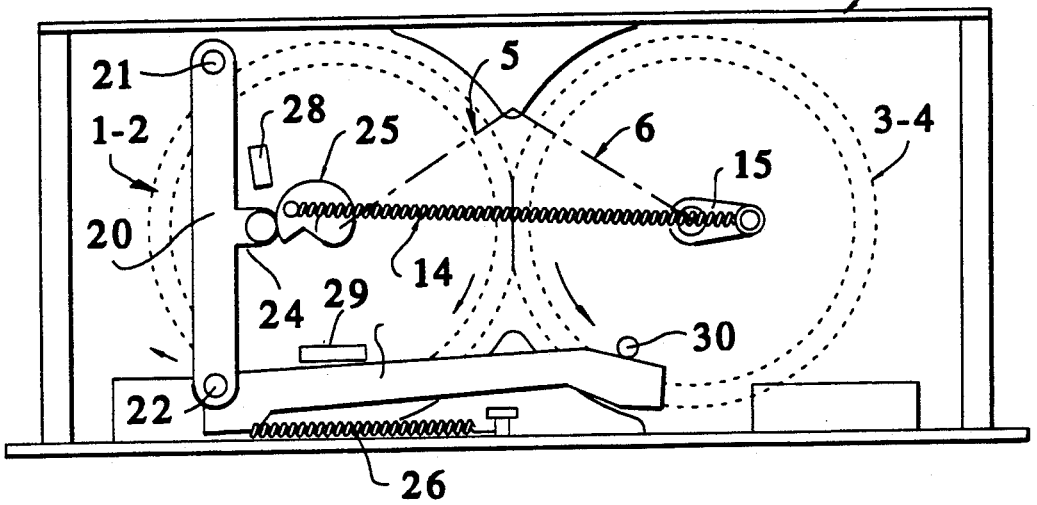
Figure 4:
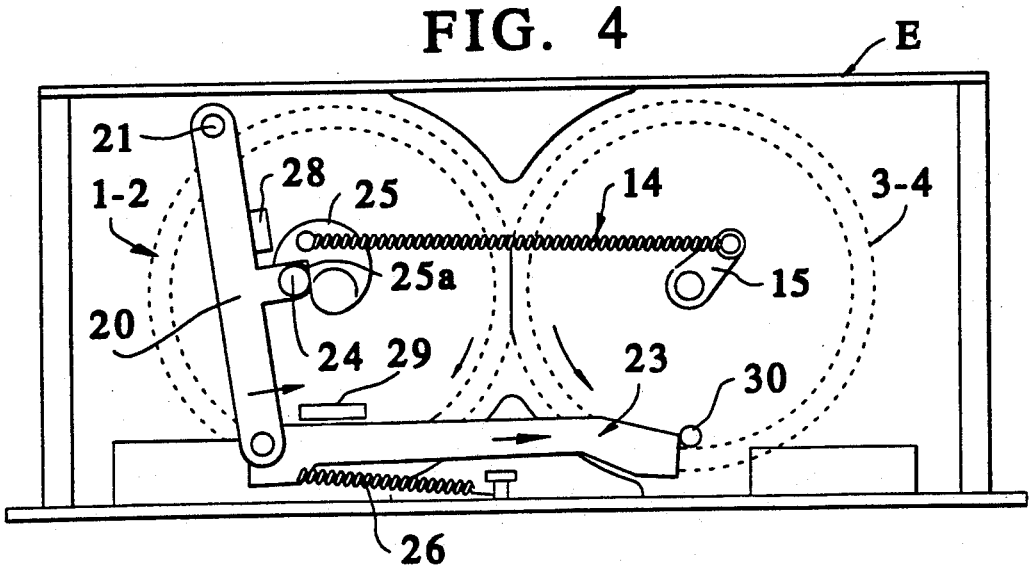

The cutting device is made up of two metal blades (5 and 6) symbolized by the line of dashes in FIGS. 2, 3 and 4, being understood that they are mounted in compliance with the copending application and patent mentioned in the above.

Therefore, according to the features of the present improvement, in order to provide for a clean and reliable cut with the unit in any position and regardless of the manual pulling force and speed applied to the strip of folded and corrugated web material projecting outwardly underneath the unit, a pusher is provided which is associated with the driving and cutting mechanisms.

The improvement component consists of a lever (20) which is hinged at (21) at the top part of the rear wall of the cassette. It extends laterally towards the bottom externally of drive wheel (1). The lever (20) is hinged at (22) at one end portion with a horizontally position push rod (23) which thereby extends in the direction externally of the other drive wheel (3). At the axle of the drive wheel (1) the lever (20) has a projection (20*a*) having perpendicularly extending therefrom a freely rotating roller (24). It is detailed to abut against a cam (25) axially mounted to the same axle to which drive wheel (1) and cog wheel (3) are journalled.

The lever (20) carrying the so-mounted roller (24) are urged in abutment onto said cam (25) by spring (26) which is attached at one end to a fixed point between the pairs of wheels at the bottom of the cassette and at its other end to an end portion of push rod (23) proximate the hinged area (22), i.e. at a downwardly extending projection (23*a*) of the push rod.

As depicted in FIG. 2, when in the idle position, the lever (20) and rod (23) together are in abutment with projections (28 and 29) which act as stops and are mounted on the rear wall of the cassette (not shown).

In this idle position corresponding to FIG. 2, the cam (25) is orientated so that roller (24) is abutment against that part which is the nearest to the axle and spring (26) is under tension.

It is to be noted the triggering spring (14) is mounted between cam (25) and an eccentric lever (15) coaxially journalled and affixed to the other drive wheel (3) thereby providing a double eccentricities.

When the folded and corrugated strip projecting from the unit is pulled manually, thereby driving both pairs of toothed wheels and at the same time the cutting blades mounted thereon, the cam (25) urges through roller (24) the lever (20) arcuately away from the axle of drive wheel (1) thus pre-stressing the spring (26) which holds the push rod (23) against stop (29).

When the cutting blades (5 and 6) are opposite one another, as in FIG. 3, the roller (24) is at the highest point of the surface of the cam (25) and the roller is now the furtherest from the axle of drive wheel (1). At this juncture drive wheel (3) due to its having been rotated has been brought perpendicularly extending projection dowel (30) fixed the wheel (3) against the other end (23*b*) of the pusher rod (23), i.e. the end opposite to hinged end for lever (20). The said projection thereby deflects downwardly pusher rod (23) in the direction of the horizontally disposed spring (26).

With the further turning of the pairs of wheels (1 and 3) and (2 and 4), each in the direction depicted in FIGS. 2, 3 and 4, the cutting blades are operatively applied against one another, the cam (25), the notch (25*a*) is now opposite roller (24) into which it is then moved. Simultaneously, the projection (30) has been moved beyond the end of pusher rod (23) thereby releasing it to proceed to move into abutment with stop (29). Therefore, as illustrated in FIG. 4, with the release of ring (26) the pusher rod (23) thrusts against the project (30) until as a result of continued rotation of drive wheel (3) it escapes therefrom. This thrust is additional to that supplied as a result of triggering spring (14) is provided to avoid braking or jamming the cutting blades in contact even when the projecting strip is pulled too gently or unevenly.

Therefore, a clean cut can be made and any undue tearing of the material is avoided. The next strip portion is always ready and projects from the unit at the same length.

The said pusher arrangement is preferably mounted to actuate the pair of toothed wheels which support the blade which is above the other one when they come into contact in order to obtain the best results.

It is also to be noted that the cam (25) may have a retainer heel after the cut to ensure full separation of the web material pulled by reaction. It being understood that just like in the copending patent and application, the blade adjustment are a function of the type of web material dispensed.

According to another feature of the improved invention it is desired to easily and quickly change the position of the cutting blades, particularly the relative positions between one another.

With regard thereto attention is now directed to FIG. 5 which is taken from the other side of the said cassette as heretofore depicted by FIGS. 2, 3, and 4. Therein, one of the blades, preferably the one which is supported by the pair of toothed wheel (1) and (3), i.e. associated with the cam (25), is mounted so as to be adjusted by a blade-support (31) hinged at (32) with the said pair. Opposite the cam, there is an opening (31*a*)of the blade-support cross which extends an eccentric (33) with its axis at (34) of said pair. When the cutting device is in the at rest position, an opening (35) of the front wall of the cassette enables a screw driver to pass therethrough to loosen bolt (32) then the eccentric is turned through a slot (33*a*) with respect to the opening (31*a*) thereby making the cutting blade to tilt forwards or backwards which varies the gap with the other blade.

Finally, in order to improve the cut even more, cutting blades not only with a convex cutting edge and inclined as shown in the said copending patent and applications are provided, but also crowned in length as can be seen from FIG. 1.

The advantages are made well apparent from the description. The following is highlighted once again. the efficiency and reliability of the cut obtained with the pusher bar storing additional energy supplied at the time of the cut and the quick blade gap adjustment in the formation of the type of material.

I claim:

1. In a dispensing device for discrete portions of a folded and corrugated wiping material, said device having a source of elongated web wiping material, spaced interleaved projection means for longitudinally folding said web materials as it is payed therebetween, counter rotating spaced intermeshing first cog wheels to receive therebetwen said longitudinally folded web material to thereby corrugate it, said first cog wheels each being keyed to an axle having keyed thereon a drive intermeshing cog wheel, said first cog wheels each having an axially disposed radially outwardly extending cutting blade adapted and constructed to cut discrete portions of wiping web materials as said material is payed said first cog wheels the improvement comprising an L-shaped lever means positioned parallel to said drive cog wheels, one end of said L-shaped lever means being hingedly affixed to said device, a helical spring being attached at one end to said device and the other to the confluence of the legs of said L-shaped lever means cam means mounted concentric with the axle carrying one of the drive cog wheels, said cam having a notch, a leg of said L-shaped lever means having a roller means detailed to rise on said cam when said drive cog wheel is rotated and to enter said notch, said cam being positioned whereby said cutting blades are in operative position when said notch is in rolled receiving position, the other drive cog wheel having a projection means positioned on its surface to abut against one end of the L-shaped lever means opposite to the hinged end when said roller is in said notch whereby kinetic energy stored by said spring when said L-shaped lever is moved as a result of cam action is released against said projection to impart a rotational force to the drive cog wheel upon which said projection is mounted.

2. The device of claim 1 wherein the L-shaped lever mounted leg portions are two portions which are hinged together.

3. The device of claim 2 wherein the leg portion of the L-shaped lever means having the roller has a projection and the roller is carried thereon.

4. The device of claim 2 wherein the cutting blades are adjustable.

5. The device of claim 4 wherein one of the blades is adjustably mounted on a blade-holder means, the blade holder means has an opening in which an eccentric cam be rotated which eccentric moves the blade holder means to and away from the other blade.

6. The device of claim 1 wherein the cutting blades have crowned configuration in length whereby to improve the cut.

* * * * *